United States Patent [19]

Dimond et al.

[11] Patent Number: 4,812,212

[45] Date of Patent: Mar. 14, 1989

[54] APPARATUS FOR CATHODICALLY PROTECTING REINFORCING MEMBERS AND METHOD FOR INSTALLING SAME

[75] Inventors: James Dimond, Burton; William Swackhammer, Hudson, both of Ohio

[73] Assignee: Harco Technologies Corporation, Medina, Ohio

[21] Appl. No.: 93,609

[22] Filed: Sep. 8, 1987

[51] Int. Cl.[4] ..... C23F 13/00

[52] U.S. Cl. ..... 204/147; 204/196; 204/294

[58] Field of Search ..... 204/147, 148, 196, 197, 204/294

[56] References Cited

U.S. PATENT DOCUMENTS

| | | | |
|---|---|---|---|
| 2,491,225 | 12/1949 | Stearns | 204/196 |
| 3,037,926 | 6/1962 | Ambler | 204/197 |
| 3,404,061 | 10/1968 | Shane et al. | 423/460 |
| 3,868,313 | 2/1975 | Gay | 204/147 |
| 4,255,241 | 3/1981 | Kroon et al. | 204/196 |
| 4,308,122 | 12/1981 | Das Gupta et al. | 204/294 |
| 4,502,929 | 3/1985 | Stewart et al. | 204/294 |

FOREIGN PATENT DOCUMENTS

| | | | |
|---|---|---|---|
| 2140456A | 11/1984 | United Kingdom | 204/196 |

OTHER PUBLICATIONS

Publication of Matcor, Inc., "Steel-in-Concrete Corrosion & Cathodic Protection", Pub. No. D-185, 1985, pp. 16-31.

*Primary Examiner*—T. Tung

*Attorney, Agent, or Firm*—Renner, Otto, Boisselle & Sklar

[57] ABSTRACT

A novel method and apparatus for cathodic protection of reinforced concrete structures includes an anode structure having an electrically conducting tape that is prevented from directly contacting the surface of the concrete structure. An electrically conducting coating is applied over the tape and in contact with the concrete surface to form an anode electrically connected to the tape and the concrete surface. The tape may conveniently employ a commercially available graphite tape with an adhered, electrically insulating backing. A preferred electrical connection to the tape includes a bus bar that compresses the tape by means of a screw engaging a masonry anchor mounted in the concrete structure. Preferably, the bus bar screw also mounts an electrically insulating junction box to the concrete surface to enclose the anode connection. The junction box may also cover an opening in the concrete surface through which the cathode connection to a reinforcing member is made. Wires connected to the terminals of a direct current power supply which provides the cathodic protection current are supplied to the junction box through which connections to the tape and cathode are made.

25 Claims, 2 Drawing Sheets

APPARATUS FOR CATHODICALLY PROTECTING REINFORCING MEMBERS AND METHOD FOR INSTALLING SAME

BACKGROUND

This invention concerns a method and apparatus for inexpensively and effectively cathodically protecting reinforcing members in reinforced concrete structures. In particular, the invention concerns an anode structure comprising an electrically conducting tape disposed on a electrically insulating backing. The backing is directly applied to a concrete structure and the tape and backing are held in place by an overlying, electrically conducting coating that completes the structure.

The corrosion of reinforcing members, which are ordinarily made of steel, in reinforced concrete structures such as bridge piers, decks and railings, parking garage floors, etc., is a constant problem. In climates where snow and ice accumulate, the brine produced by ice-melting salts induces and accelerates the corrosion problem. Salt-accelerated corrosion is also encountered in coastal areas where salt water contacts reinforced concrete structures. Chloride ions accelerate the corrosion of steel reinforcing members and help generate corrosion products that occupy a larger volume than the uncorroded steel. The corrosion products create severe internal pressure on the concrete resulting in cracking and spalling. Once cracking and spalling begin, access to reinforcing members increases, further accelerating the rate of corrosion, cracking and spalling.

Cathodic protection is a well known and effective method of combating corrosion in reinforced concrete structures. In cathodic protection, a small electrical current supplied by an external direct current power source flows from an anode disposed on the surface of the concrete to the reinforcing members within the concrete structure which act as a cathode. This current flow counteracts the electrical current that would flow in the course of electrochemical corrosion of the reinforcing members and inhibits the electrochemical corrosion reaction. The negative sense terminal of the external power supply is connected to the reinforced structure by exposing a reinforcing member at one or more locations so that the necessary electrical connections can be made. The openings are then covered with fresh concrete, grout or another material to protect the reinforcing members.

A number of techniques for making anode connections to reinforced concrete structures are known. A typical connection is disclosed in U.S. Pat. No. 4,255,241 to Kroon et al. for "Cathodic Protection Apparatus And Method For Steel Reinforced Concrete Structures". There, an anode is formed in a slot sawn into the concrete structure. An insulator is disposed on the innermost surface of the slot. The slot is then filled with an electrically conducting material in which is suspended a platinized niobium wire. The remainder of the slot is filled with an inert material so that a surface flush with the original surface of the concrete is formed.

Known anode structures, like those disclosed by Kroon, require an expensive platinized niobium wire. The installation process for those anode structures requires a significant amount of expensive labor. Accordingly it is desirable that a cathodic protection system for reinforced concrete structures employ an anode structure that is inexpensive both in materials cost and the cost of installation.

SUMMARY OF THE INVENTION

The present invention employs low cost materials and a simple installation method for an anode structure and for apparatus for cathodic protection of reinforcing members in reinforced concrete structures. The anode structure is constructed on site in the course of its installation. In a preferred embodiment, the only working of concrete on site during installation of an embodiment of the invention is simple drilling.

In a preferred embodiment of the invention, the anode structure comprises an electrically conducting tape disposed on an electrically insulating backing or substrate. The tape may preferably be a commercially available graphite tape with or without an adhered paper backing. The tape is applied to an insulating backing, if necessary, and the backing is placed in contact with the concrete surface of the structure to be protected. In order to hold the tape and/or backing in place permanently, an electrically conducting paste, or relatively viscous fluid, is spread on the top of the tape and on the adjacent areas of concrete. This conductive material may be commercially available mastic or polymer that is filled with electrically conducting particles. Alternatively, an electrically conductive coating may be applied to the tape and adjacent concrete surface. It is important that the tape not directly contact the concrete. The insulating backing prevents deterioration of the tape as the cathodic protective current flows. The tape provides the electrical connection between the power source and the anode formed by the electrically conductive material applied in the field. The resistivity of the adhesive or coating may be lower than that of the tape.

The cathode connections to the reinforcing members can be made in the conventional way. However, in a preferred embodiment, the novel apparatus includes a junction box that is directly mounted on the concrete surface to protect the electrical connections. Before mounting the junction box, access to a reinforcing member is gained by drilling or some other technique and the cathodic connection is made. Preferably, the junction box is mounted to cover the opening communicating with the exposed reinforcing member. The wire connecting the power supply to the exposed reinforcing member preferably passes through the box to the reinforcing member. In a preferred embodiment, the electrically conducting tape of the anode structure is terminated by a compression connector which includes a bus bar that clamps an end of the tape. The compression connection is preferably disposed within the junction box. It is preferred that the compression member mount on the concrete surface and that its mounting also provide mounting support to the junction box.

The remainder of the apparatus, namely a direct current power source and electrical connections from the source to each junction box, is conventional. Conventional conduit may be used to carry the power lines from the source to the electrodes of the apparatus. A pluality of anode structures according to the invention may be disposed at various locations over the surface of a reinforced concrete structure, preferably each disposed near a cathodic connection to a reinforcing member.

DETAILED DESCRIPTION OF PREFERRED EMBODIMENTS

Figure 1:
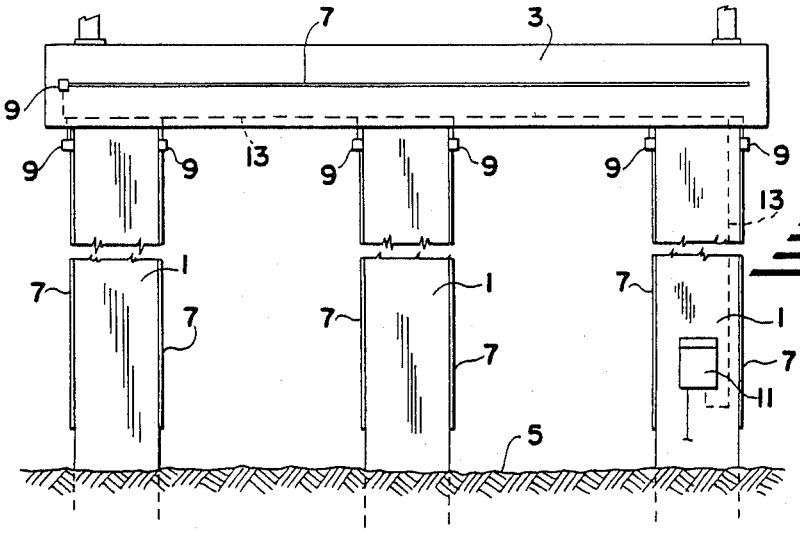
FIG. 1 is a side view of a pier structure made of reinforced concrete and having an embodiment of the apparatus according to the invention installed on it.

In all of the drawing figures, like elements are given the same reference numbers.

Figure 3:
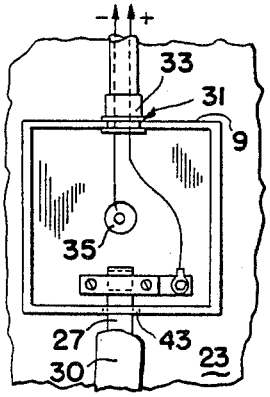
FIG. 3 is a front view of a junction box, with the front cover removed, illustrating one embodiment of electrical connections to the electrodes according to the invention.

In FIG. 1 a typical application of an embodiment of the invention is shown. There, three piers 1, constructed of reinforced concrete, support a generally horizontal pier cap 3 also constructed of reinforced concrete. As is conventional, piers 1 are supported on subterranean supports (not shown) below grade level 5. An anode structure 7 is disposed on each of two opposing faces of each of piers 1 extending from just above grade level 5 to near pier cap 3. Just beneath pier cap 3, each of anode structures 7 enters a junction box 9 which is shown in greater detail in FIGS. 3 and 4. Another anode structure 7 is disposed generally horizontally on a surface of pier cap 3 and enters a junction box 9 disposed at one end of pier cap 3. As explained below, each of junction boxes 9 preferably encloses an electrical connection for the anode structure and protects the electrical connection to the cathode, which is the framework of electrically conducting reinforcing members within the concrete structure.

Direct current electrical power is supplied to the anodes and cathodes of FIG. 1 by a power source 11 mounted on one of piers 1. Electrical power is distributed from source 11 in a conventional way through wires contained in a conduit 13 indicated by dashed lines in FIG. 1. The conduit is mounted on the concrete structure in a conventional manner. Power supplies for use in cathodic protection systems are available from Harco Corporation, Medina, Ohio and other suppliers.

Figure 2:
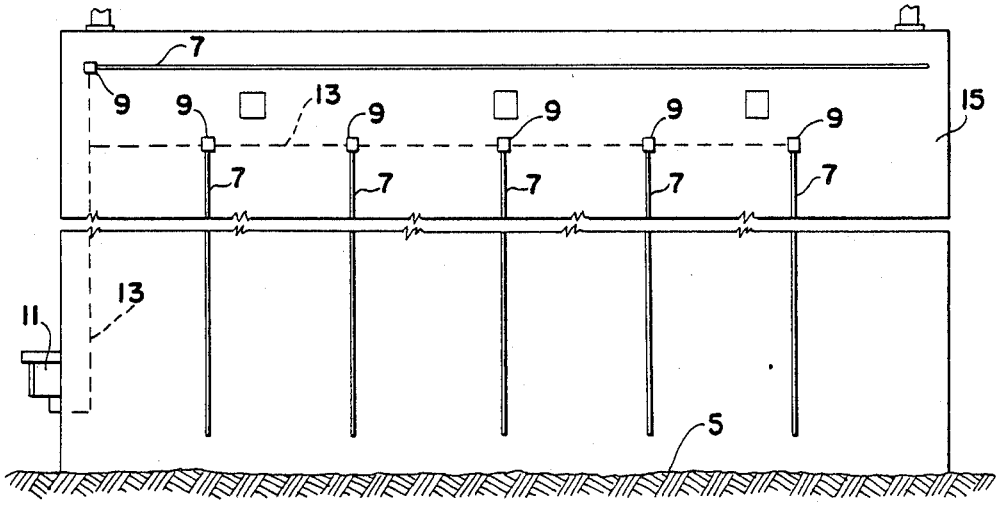
FIG. 2 is a front view of a reinforced concrete wall having an embodiment of the apparatus according to the invention mounted on it.

In FIG. 2, a reinforced concrete retaining wall or pier 15 that is cathodically protected by an embodiment of the invention is shown. A number of generally vertically disposed anode structures 7 are spaced on the face of wall 15. A generally horizontally disposed anode structure 7 is attached to wall 15 near its top. Each of anode structures 7 is terminated within a junction box 9 through which cathode connections to the reinforcing steel network are also preferably made. Conduit 13 contains electrically interconnecting wires for the anodes and cathodes to connect them to a direct current power source 11 also mounted on wall 15. Conduit 13 is indicated by a dashed line although it is conventionally a pipe or tube that resists corrosion.

Figure 6:
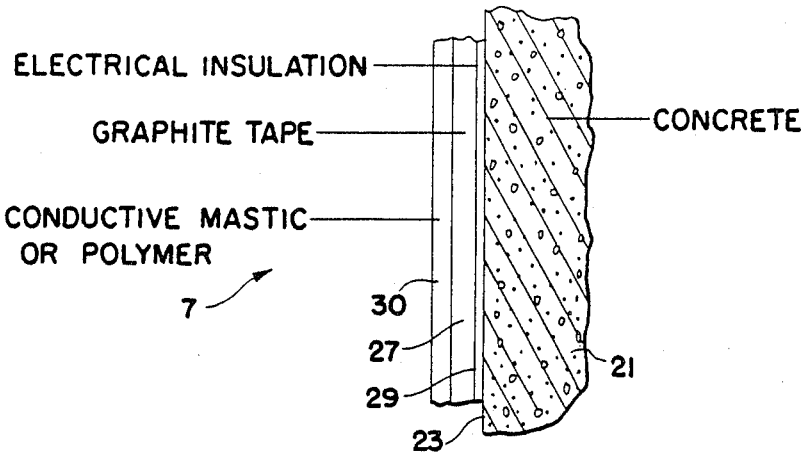
FIG. 6 is a sectional side view of the construction of an anode structure according to an embodiment of the invention.

Turning to FIG. 6, a detailed sectional view of anode structure 7 according to the invention of FIGS. 1 and 2, is shown mounted on the surface of a reinforced concrete structure 21. The portion of the concrete structure 21 shown in FIG. 6 includes an external surface 23 on which the novel anode structure is mounted. The anode structure preferably comprises an electrically conductive tape 27 disposed on an electrically insulating backing 29 that is in direct contact with concrete surface 23. The term tape as used here generally refers to a conductor having in cross section a first dimension that is larger than a second dimension that is transverse to the first dimension. In a preferred embodiment, the tape may have a generally rectangular cross section; however, the invention is not limited to a conductive tape having a particular cross sectional configuration.

Preferably, electrically conducting tape 27 is formed from a low cost material rather than the platinized niobium wire that is now used in cathodically protected reinforced concrete structures. We have found that a commercially available graphite thread sealant tape sold under the trademark GRAFOIL by Union Carbide Corporation is a suitable material for anode tape 27. The composition and method of making the GRAFOIL tape is described in U.S. Pat. No. 3,404,061 to Shane et al. for "Flexible Graphite Material Of Expanded Particles Compressed Together". This sealant tape may include an electrically non-conductive backing adhered to one face of the tape that is useful as insulating member 29 shown in FIG. 6. The tape is commercially available in a number of thicknesses and widths.

GRAFOIL is also available as a valve packing material without an electrically insulating backing. Graphite tape without an insulating backing may also be used as tape 27 of anode structure 7 provided that an electrical insulator is interposed between the conducting tape and concrete surface 23. It is important that the insulating substrate be present since the electrical conductor used in the invention is more electrochemically active than the expensive platinized niobium wire that has been used in known cathodic protection apparatus. Thus the conductor is more susceptible to erosion from electrical current flow than is planitized wire. By preventing direct contact between tape 27 and concrete surface 23 with insulator 29, the erosion that could result if there were direct contact is avoided. It follows that insulator 29 could be of a smaller area per unit of length than tape 27, but that it is preferred that insulator 29 have at least the same area per unit of length as the tape 27 to prevent direct contact between the tape and concrete surface 23.

Some means must be provided to hold tape 27 and insulator 29 in the desired location on concrete surface 23 and to make the anode connection from tape 27 to surface 23. It is preferred that the fixation and connection means be an electrically conducting material 30 that is applied on the exposed surface of tape 27 and along its sides to extend beyond the tape and contact concrete surface 23. (Because FIG. 6 is a sectional side view, the portion of material 30 extending to surface 23 is not readily apparent in that Figure.) This overlying electrically conductive material, the anode, is preferably not interposed between insulator 29 and surface 23. It is important that the overlying conductive material, the anode, have a relatively low electrical resistivity so that it spreads the anodic current conducted by the tape and discourages erosion of the tape by electrical currents.

Electrically conductive materials that form suitable anodes are commercially available as mastics, polymers and other coatings. These mastics, polymers and coatings can be applied to the tape by spraying, brushing, troweling or other conventional means. Once the electrically conducting coating forming the anode cures, it is usually effective in holding the anode structure in place and providing the necessary electrical connection.

Separate electrical connections must be made to the tape that supplies electrical current to the anode and to the reinforcing members of the concrete structure, the cathode, from power supply 11. In a preferred embodiment, a junction box 9, shown in detail in FIGS. 3 and 4, encloses the tape connection and protects both the positive and negative connections from the weather. Junction box 9 includes an aperture 31 through which electrical leads from direct current power supply 11 enter. Aperture 31 is weatherproofed with an appropriate fitting or grommet 33. Preferably, junction box 9 is mounted directly on surface 23 of the concrete structure and includes an opening 35 in the surface of the box that contacts structure 21.

Before mounting of box 9, an opening is made in concrete 21 from surface 23 to gain access to a reinforcing member 39 in order to make the cathode connection. Opening 37 may be made in a conventional manner such as hammering and chipping or, preferably, simple drilling. Once access to member 39 is gained, an electrical connection 41 between reinforcing member 39 and a wire 42 connected to the negative sense terminal of power supply 11 is made in a conventional manner known to those skilled in the art. The area of opening 37 in surface 23 is preferably smaller than the area of the rear wall 47 of junction box 9 so that box 9 may cover the opening and protect the cathodic connection from weather. If desired, box 9 may include a peripheral gasket or caulking (not shown) to provide additional protection against weather.

Figure 4:
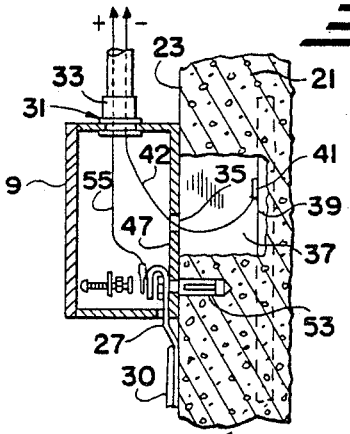
FIG. 4 is a sectional side view of a junction box mounted on a reinforced concrete surface and depicting an embodiment of electrode connections according to the invention.
Figure 5:
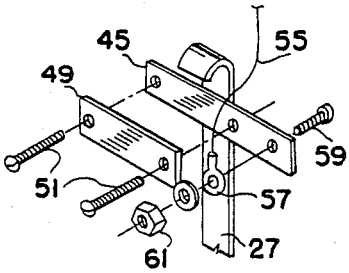
FIG. 5 is an exploded view of an embodiment of a termination of an anode structure according to the invention.

A preferred embodiment of an electrical connection to tape 27 is shown most clearly in FIGS. 4 and 5. Tape 27 emerges from anode 30 just below box 9 and enters the junction box through an aperture 43, best seen in FIG. 3. Electrical connection to the tape is made by a compression connector shown in FIG. 5. The compression connector includes an electrically conducting bus bar 45, preferably made of copper or some other metal that makes a low resistance contact to tape 27. Tape 27 is preferably disposed between one side of bus bar 45 and back wall 47 of junction box 9. To avoid shortcircuiting, junction box 9 is preferably made of an electrically insulating material. Tape 27 is curled over bus bar 45 and contacts both opposed surfaces of the bus bar. Tape 27 is clamped to bus bar 45 by an optional strap 49 which may be an electrical insulator or conductor. In the embodiment illustrated, strap 49 compresses tape 27 against bus bar 45 by means of two screws 51 that pass through junction box back wall 47 to engage masonry anchors 53 that have been previously installed in holes drilled in concrete 21 through surface 23. Not only do screws 51 clamp tape 27, but they also provide a means of mounting junction box 9 to concrete structure 21. If strap 49 is omitted, bus bar 45 clamps tape 27 only against back wall 47 of junction box 9. This pressure provides a satisfactory electrical contact. When strap 49 is present, tape 27 is clamped in two locations, improving reliability.

Screws 51 and/or anchors 53 are made of an insulating material, such as plastic, to avoid creating a high conductivity electrial path directly between tape 27 and concrete 21. An electrical connection from power supply 11 to bus bar 45 is made in a conventional manner. In the embodiment shown, a conductor 55 connected to the positive sense terminal of power supply 11 is terminated in an eyelet 57. Eyelet 57 is held against bus bar 45 by means of a bolt 59 that passes through a hole in bus bar 45 and through eyelet 57 to engage a nut 61. The electrical connection embodiments shown are inexpensive to make, easy to install and reliable.

A particular advantage of the embodiment of the invention described is the simplicity with which it may be installed. Once the desired locations of the anode structures and junction boxes are identified, the concrete structure is opened at each of the junction box locations to gain access to a reinforcing member for the cathode connection. Although, in general, the reinforcing members are all electrically conducting and in electrical communication with each other, it is preferred to make multiple electric connections to the reinforcing members to avoid excessive resistive losses. Once the openings have been made, it is preferred that the surfaces on which the anode structures are to be disposed be cleaned for establishing good adherence and electrical contact between the anodes and concrete. The surfaces may be cleaned by scrubbing with a detergent, spraying with a mild etchant and rinsing or, preferably, lightly sandblasting the anode contact area. Thereafter, the conductive tape is applied and temporarily held in place, for example with pressure sensitive adhesive tape, until the electrically conductive material is applied to the tape and adjacent concrete surface. Use of a conducting tape with an adhesive insulating backing simplifies the installation procedure. However, use of a separate insulating substrate does not unduly complicate installation of the structure. The electrical connections to the direct current power source can then be connected and the junction box mounted in previously installed masonry anchors.

No cutting of slots or removal of substantial amounts of concrete is required to install the illustrated embodiment of the invention. As previously mentioned, additional steps may be taken to seal the junction box to the concrete surface, such as caulking. While the opening prepared in the concrete to make the cathodic connection could be filled with concrete, a grout or another insulating material, it is preferable to leave the opening empty so that easy access to the cathode connection is available, if necessary. Should servicing or replacement of the anode structure be necessary, all parts of it are readily accessible for removal or repair.

The invention has been described with respect to certain preferred embodiments. Various additions and other modifications within the spirit of the invention will occur to those of skill in the art. Accordingly, the scope of the invention is limited solely by the following claims.

We claim:

1. An anode structure for use in apparatus for cathodically protecting electrically conducting reinforcing members in a reinforced concrete structure comprising:

an electrically conductive graphite tape having a first electrical resistivity, for conducting a cathodic protection current from a direct current power source;

an electrically insulating backing disposed between said tape and a surface of a reinforced concrete structure to be cathodically protected, for preventing direct contact of said tape with said surface; and an electrically conductive anode coating disposed on said tape and on said surface adjacent the tape for conducting a cathodic protection current to said reinforcing member.

2. The anode structure of claim 1 wherein said backing comprises paper adhered to said graphite tape.

3. The anode structure of claim 1 wherein said anode coating comprises an electrically conductive mastic.

4. The anode structure of claim 1 wherein said anode coating comprises an electrically conductive polymer.

5. The anode structure of claim 1 including termination means for making an electrical connection to said tape.

6. The anode structure of claim 5 wherein said termination means comprises a bus bar for electrically contacting said tape and means for compressing said bus bar against said tape.

7. The anode structure of claim 6 wherein said bus bar includes at least one hole and said means for compressing includes a fastener for passing through said hole and engaging an anchor mounted in said reinforced concrete structure.

8. The anode structure of claim 7 including junction box for enclosing said termination means, said junction box means containing an aperture for passage of said tape into said box means.

9. The anode structure of claim 8 wherein said junction box means is made of an electrically insulating material.

10. An apparatus for cathodic protection of electrically conducting reinforcing members in a reinforced concrete structure, said apparatus comprising:

an electrically conductive graphite tape having a first elecrtrical resistivity for conducting a cathodic protection current from a direct current power source;

an electrically insulating backing disposed between said tape and a surface of a reinforced concrete structure to be cathodically protected, for preventing direct contact of said tape with said surface, an electrically conductive anode coating disposed on said tape opposite said backing and on said surface adjacent to said tape for conducting a cathodic protection current to said reinforcing member; and direct current electrical power source means for supplying a cathodic protection current and having positive and negative polarity terminals, said negative polarity terminal electrically connected to said reinforcing member of said structure and said positive terminal electrically connected to said tape.

11. The apparatus of claim 10 wherein said backing comprises paper adhered to said graphite tape.

12. The apparatus of claim 10 wherein said anode coating comprises an electrically conductive mastic.

13. The apparatus of claim 10 wherein said anode coating comprises an electrically conductive polymer.

14. The apparatus of claim 10 including termination means for making an electrical connection to said tape means.

15. The apparatus of claim 14 wherein said termination means comprises a bus bar for electrically contacting said tape and means for compressing said bus bar against said tape.

16. The apparatus of claim 15 wherein said bus bar includes at least one hole and said means for compressing includes a fastener for passing through said hole and engaging an anchor mounted in said reinforced concrete structure.

17. The apparatus of claim 16 including junction box means for enclosing said termination means, said junction box means containing an aperture for passage of said tape into said box means.

18. The apparatus of claim 17 wherein said junction box means is made of an electrically insulating material.

19. The apparatus of claim 15 wherein said junction box means includes a second opening for receiving wires electrically connected to said power source means and a third opening for passing one of said wires out of said box means for electrical connection to one of said reinforcing members.

20. A method of installing an anode structure on a reinforced concrete structure containing electrically conducting reinforcing members to be cathodically protected comprising:

applying an electrically conductive graphite tape having a first electrical resistivity and an electrically insulating backing to a surface of a reinforced concrete structure to be cathodically protected so that said backing is disposed between said tape and said surface and said tape does not directly contact said surface; and applying an electrically conductive anode coating having an electrical resistivity smaller than said first electrical resistivity over said tape and on said surface adjacent said tape.

21. The method of claim 20 including cleaning the surface of said structure where said coating and backing are to be disposed before applying said backing.

22. The method of claim 20 including electrically connecting the positive terminal of a direct current power supply to said tape.

23. The method of claim 22 including connecting said tape by compressing it with a bus bar by mounting said bus bar to said structure.

24. The method of claim 23 including mounting an electrically insulating junction box containing said bus bar to said structure simultaneously with mounting said bus bar.

25. The method of claim 24 further including removing concrete from said structure to expose a reinforcing member and electrically connecting the negative terminal of said direct current power supply to said exposed member.

* * * * *